US010145632B2

(12) United States Patent
Dienno

(10) Patent No.: US 10,145,632 B2
(45) Date of Patent: Dec. 4, 2018

(54) REPLACEMENT RECEIVER ASSEMBLY FOR AN AK-47

(71) Applicant: Eric Dienno, Westchester, PA (US)

(72) Inventor: Eric Dienno, Westchester, PA (US)

( * ) Notice: Subject to any disclaimer, the term of this patent is extended or adjusted under 35 U.S.C. 154(b) by 0 days.

(21) Appl. No.: 15/499,352

(22) Filed: Apr. 27, 2017

(65) Prior Publication Data

US 2017/0314880 A1 Nov. 2, 2017

Related U.S. Application Data

(60) Provisional application No. 62/328,937, filed on Apr. 28, 2016.

(51) Int. Cl.

| | |
|---|---|
| ***F41A 3/66*** | (2006.01) |
| ***F41A 17/00*** | (2006.01) |
| ***F41A 11/00*** | (2006.01) |

(52) U.S. Cl.

CPC ..... *F41A 3/66* (2013.01); *F41A 11/00* (2013.01); *F41A 17/00* (2013.01)

(58) Field of Classification Search

CPC .. F41A 11/00; F41A 11/02; F41A 3/66; F41A 17/00; F41A 17/38; F41A 35/00

USPC ..... 89/1.4; 42/71.01, 75.02, 75.03

See application file for complete search history.

(56) References Cited

U.S. PATENT DOCUMENTS 8,266,998 B1 * 9/2012 Davis ..... F41A 35/06 42/71.01
9,068,793 B1 * 6/2015 Barrett ..... F41C 23/16
9,091,505 B1 * 7/2015 Battaglia ..... F41C 23/20
9,528,782 B2 * 12/2016 Meier ..... F41A 3/66
9,777,975 B2 * 10/2017 Folkestad, II ..... F41A 3/66
9,958,229 B1 * 5/2018 Meier ..... F41A 35/02
2005/0257412 A1 * 11/2005 Quis ..... F41A 3/66 42/71.01
2012/0102804 A1 * 5/2012 Fesas ..... F41A 3/66 42/90
2012/0131838 A1 * 5/2012 Edge ..... F41G 11/003 42/90
2012/0180647 A1 * 7/2012 Dublin ..... F41A 3/72 89/191.01
2012/0198990 A1 * 8/2012 Brittin ..... F41A 5/26 89/191.01
2013/0185975 A1 * 7/2013 Johnson ..... F41A 19/09 42/69.02
2014/0224114 A1 * 8/2014 Faxon ..... F41A 15/14 89/193
2014/0331538 A1 * 11/2014 Spiegelhauer ..... F41C 23/16 42/71.01
2015/0052793 A1 * 2/2015 Cassady ..... F41A 17/38 42/8

(Continued)

*Primary Examiner* — Joshua E Freeman

(74) *Attorney, Agent, or Firm* — Parsons & Goltry; Robert Parsons; Michael Goltry

(57) ABSTRACT

A receiver for an AK-47 style firearm includes an upper receiver and a lower receiver. The upper receiver includes a first side element, a second side element coupled to the first side element, a trunnion support formed between the first side element and the second side element proximate a forward end thereof, and a pivot block formed between the first side element and the second side element intermediate the forward end and a rearward end thereof. The lower receiver is hingedly coupled to the pivot block and movable between an open position and a closed position.

18 Claims, 6 Drawing Sheets

(56) References Cited

U.S. PATENT DOCUMENTS

| | | | | |
|---|---|---|---|---|
| 2016/0033218 | A1* | 2/2016 | Folkestad, II | F41A 3/66 89/194 |
| 2016/0033219 | A1* | 2/2016 | Meier | F41A 3/66 89/191.01 |
| 2016/0223288 | A1* | 8/2016 | Sain | F41C 27/00 |
| 2017/0167814 | A1* | 6/2017 | Larson, Jr. | F41A 17/38 |
| 2017/0268839 | A1* | 9/2017 | Geissele | F41A 3/86 |

* cited by examiner

REPLACEMENT RECEIVER ASSEMBLY FOR AN AK-47

CROSS-REFERENCE TO RELATED APPLICATIONS

This application claims the benefit of U.S. Provisional Patent Application No. 62/328,937, filed 28 Apr. 2016.

FIELD OF THE INVENTION

This invention relates to firearms. More particularly, the present invention relates to modifications made to an AK-47 firearm.

BACKGROUND OF THE INVENTION

In the field of firearms, a receiver is an important component. A firearm receiver is the base upon which a firearm is built. The receiver carries the operating mechanisms of the firearm as well as many of the accessories, the butt stock and the barrel. Because of the central nature of the receiver, it is important for the receiver to be strong and stable. In a Kalashnikov style firearm, such as the ubiquitous AK-47 style firearm and the lesser known AK-74 style firearm (all herein referred to as AK-47 style firearm), the receiver includes a lower receiver made of stamped steel and a receiver cover covering the top of the lower receiver. While inexpensive and functional, the stamped receiver is heavy, formed with low tolerances and is relatively flexible, adversely effecting accuracy. Additionally, the receiver cover of an AK-47 is very light sheet metal and is insufficiently rigid to carry accessories such as optics and the like. Optical aiming devices mounted on a receiver cover are not stable. The instability greatly and negatively impacts the accuracy of the firearm.

Attempts to overcome these problems have essentially reconfigured Kalashnikov style firearms, replacing most if not all of the components. This eliminates one of the most attractive features of a firearm such as an AK-47, namely the low cost. By using special components instead of stock components, these firearms are much more expensive.

It would be highly advantageous, therefore, to remedy the foregoing and other deficiencies inherent in the prior art.

An object of the present invention is to provide a replacement receiver for a Kalashnikov style firearm.

Another object of the present invention is to provide a more robust receiver.

SUMMARY OF THE INVENTION

Briefly, to achieve the desired objects and advantages of the instant invention, provided is a receiver for an AK-47 style firearm including an upper receiver and a lower receiver. The upper receiver includes a first side element, a second side element coupled to the first side element, a trunnion support formed between the first side element and the second side element proximate a forward end thereof, and a pivot block formed between the first side element and the second side element intermediate the forward end and a rearward end thereof. The lower receiver is hingedly coupled to the pivot block and movable between an open position and a closed position. The receiver is intended to support stock elements for an AK-47 style firearm.

Also provided is a barrel assembly including a trunnion coupled to a rifle barrel. The barrel assembly is coupled to the receiver, with the trunnion captured between the first side element and the second side element and supported by the trunnion support. A gas piston, a bolt carrier and a bolt are received into position within the upper receiver through the rearward end thereof when the lower receiver is in the open position.

BRIEF DESCRIPTION OF THE DRAWINGS

The foregoing and further and more specific objects and advantages of the invention will become readily apparent to those skilled in the art from the following detailed description of a preferred embodiment thereof, taken in conjunction with the drawings in which.

DETAILED DESCRIPTION OF A PREFERRED EMBODIMENT

Figure 1:
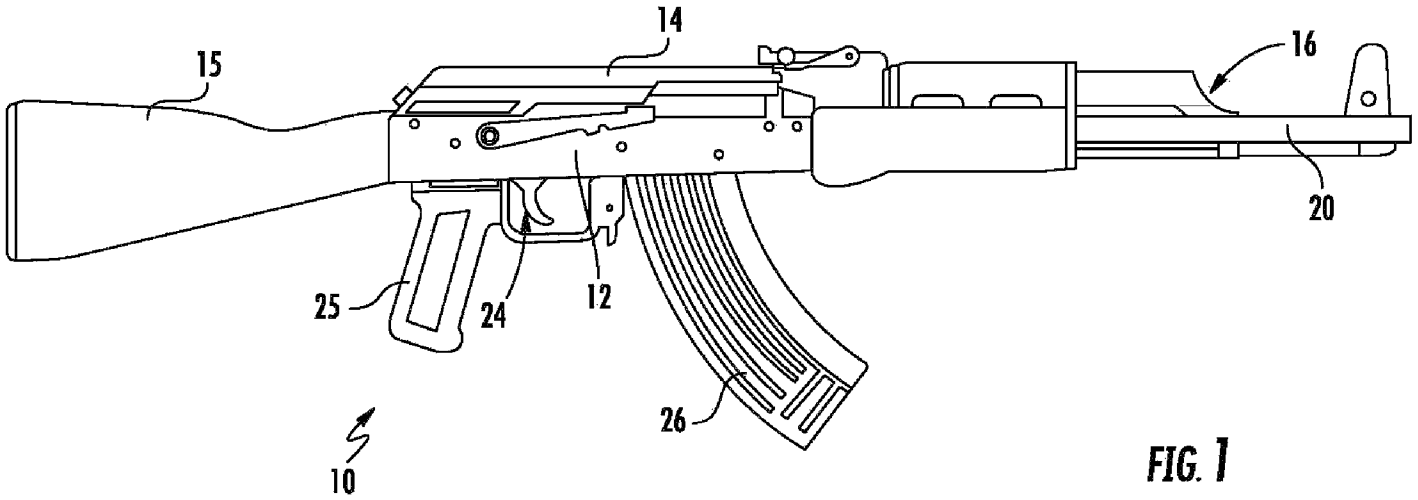
FIG. 1 (PRIOR ART)
FIG. 1 is a side view of a convention AK-47 firearm.
Figure 2:
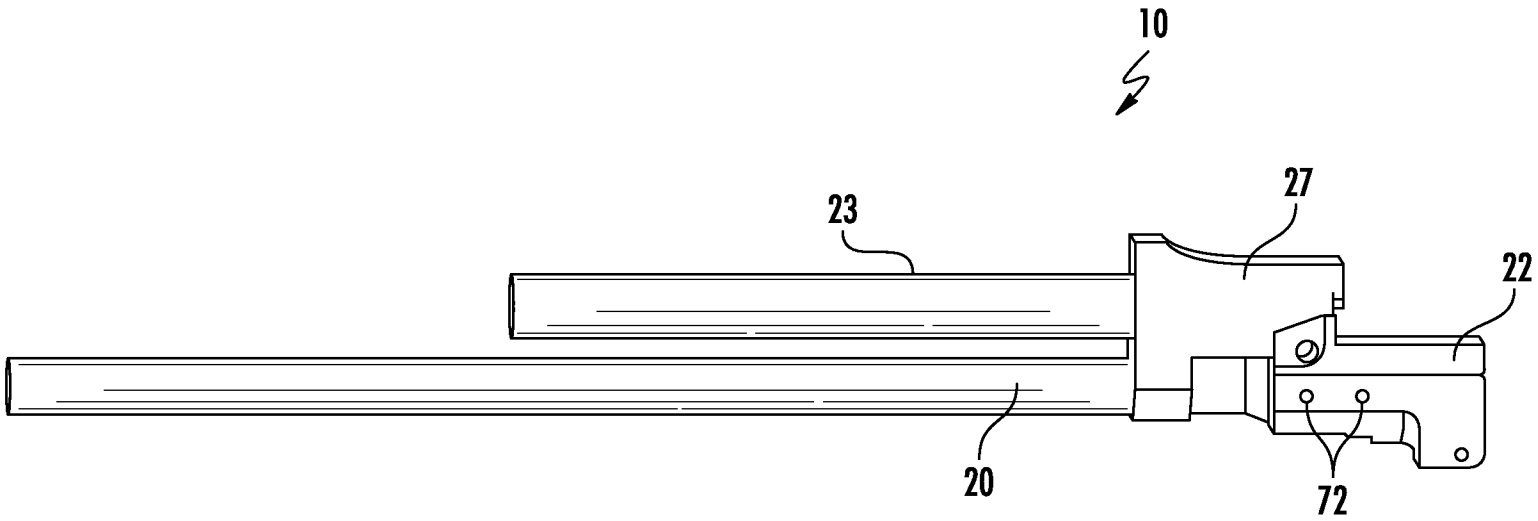
FIG. 2 is a side view illustrating a barrel assembly of an AK-47 firearm.

The present invention is concerned with modifications to an AK-47 style firearm. An AK-47 is a firearm used throughout the world and known for its low cost, durability, ease of use and reliability. There are many variants to the AK-47, but it is understood that all are generally designated by the generic phrase "AK-47". Referring to FIG. 1, a generic AK-47 generally designated 10, is illustrated. Conventional AK-47 10 includes a receiver 12 and a receiver cover 14. A buttstock 15 is coupled to a rearward end of receiver 12, and a barrel assembly 16 is coupled to a forward end of receiver 12. With additional reference to FIG. 2, barrel assembly 16 includes a barrel 20 coupled to a trunnion 22. A gas cylinder 23 is coupled to the top of barrel 20 with a rear sight base 27. Trunnion 22 is fixed to the forward end of receiver 12 anchoring barrel 20. AK-47 10 also includes a trigger assembly 24, a pistol grip 25 and a magazine 26 carried by receiver 12. While AK-47 10 has utility, receiver 12 and receiver cover 14 are problematic in the conventional AK-47. Specifically, receiver 12 and receiver cover 14 are generally made from stamped sheet metal. While inexpensive, receiver 12 is much too flexible to provide a stable platform for a firearm, and thus, is detrimental to the accuracy of the firearm. Additionally, the single piece receiver 12 is covered by a receiver cover 14. Cover 14 is also very flexible sheet metal which does nothing to stabilize receiver 12, and does not allow or provide a stable platform for the addition of currently available accessories such as optics and the like.

Many AK-47 style firearms are being manufactured, but these AK-47 style firearms do not use the original components of AK-47 10. The present invention uses the components of a conventional AK-47, specifically the inner workings, and replaces receiver 12 and receiver cover 14.

Figure 3:
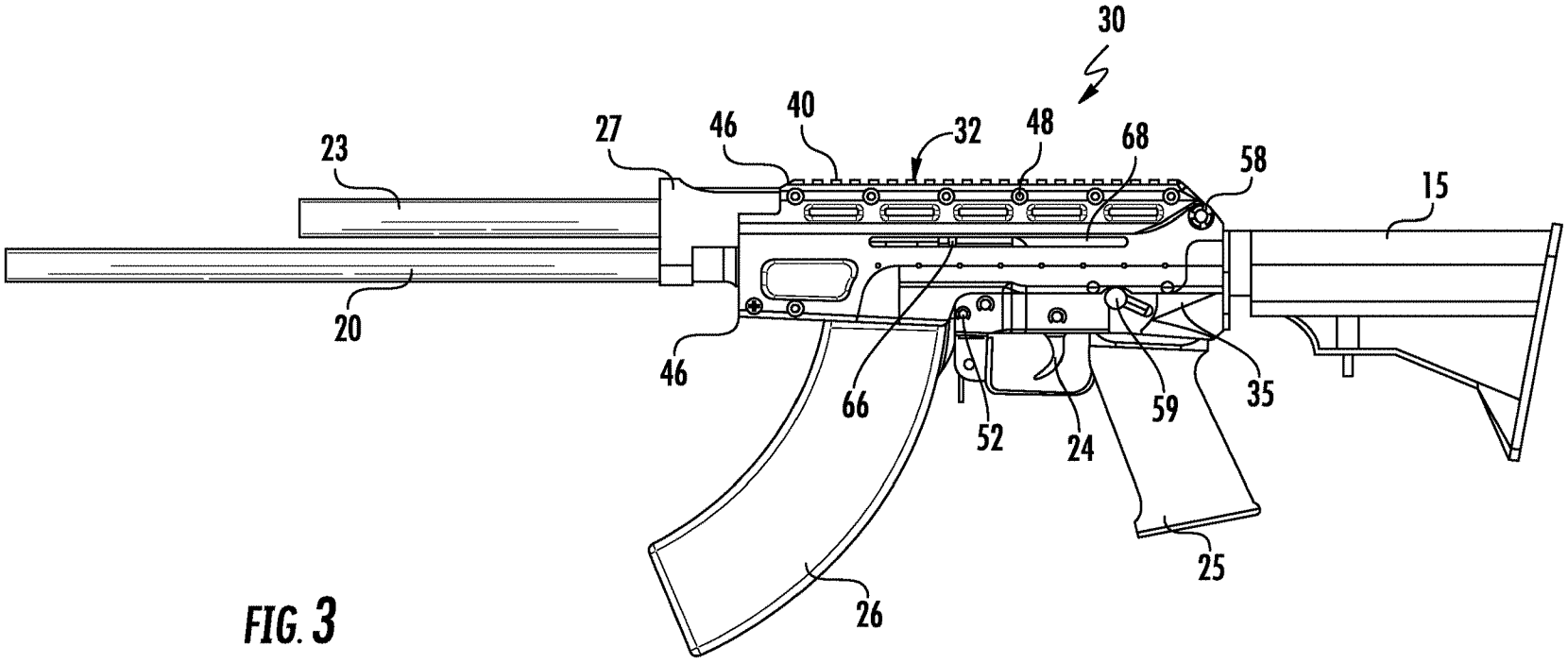
FIG. 3 is a side view of an AK-47 modified according to the present invention.
Figure 4:
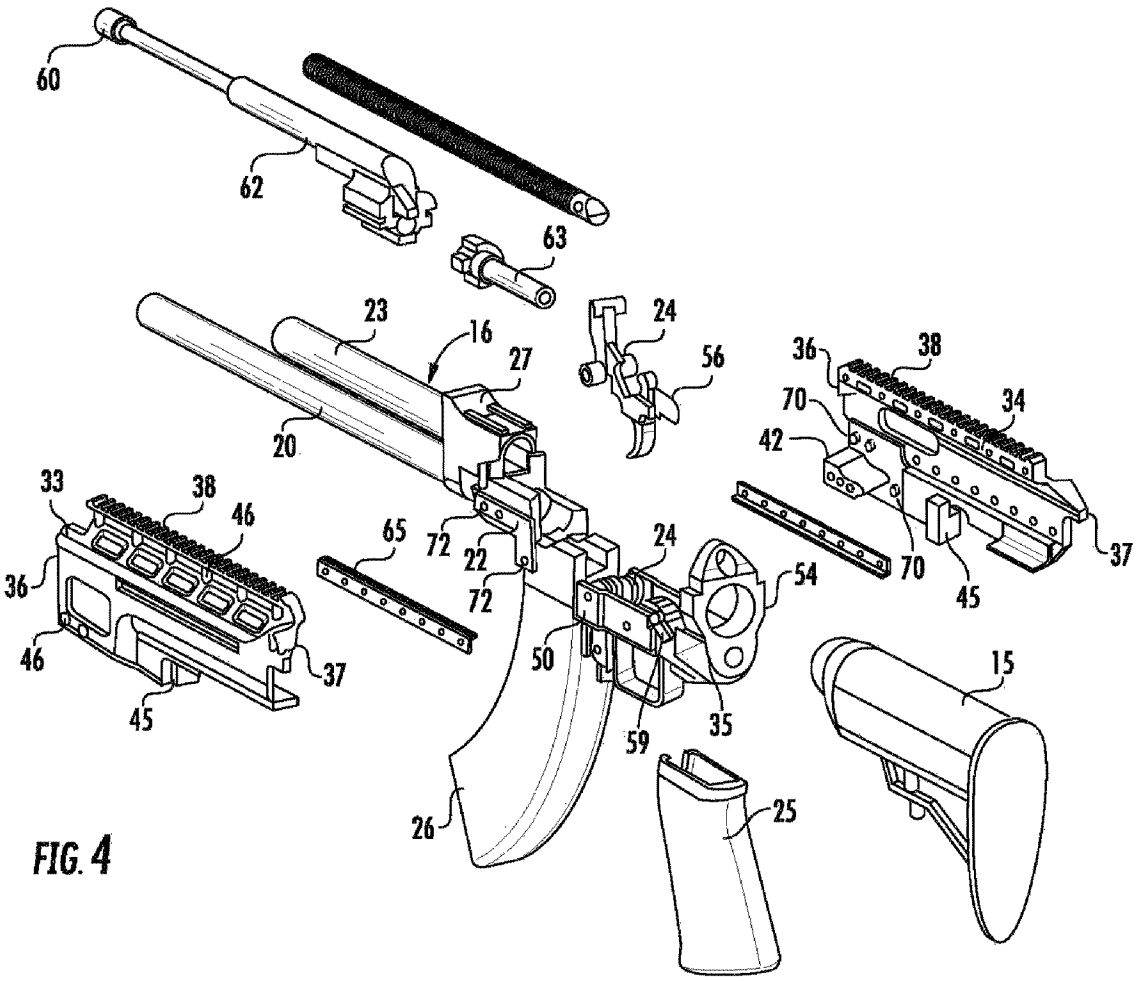
FIG. 4 is an exploded view of the modified AK-47 of FIG. 3.

Turning now to the drawings in which like reference characters indicate corresponding elements throughout the several views, attention is directed to FIGS. 3 and 4 which illustrate a modified AK-47 according to the present invention, generally designated 30. AK-47 30 includes an upper receiver 32, consisting of a pair of opposing side elements 33 and 34, and a lower receiver 35. Opposing side elements 33 and 34 each include a forward end 36, a rearward end 37, and a top 38. When fitted together to form upper receiver 32, tops 38 of side elements 33 and 34 engage to form a rail 40. Rail 40 can be substantially any form a rail, but is preferably a standard picatinny type rail which can accommodate most of the accessories in today's market. In the preferred embodiment, side elements 33 and 34 are fabricated of aluminum to provide lightweight strength, and are machined to provide close tolerances. Forging and machining the elements can also be employed.

A forward block 42 extends inwardly from forward ends 36 of each of side elements 33 and 34. When side elements 33 and 34 are joined to form upper receiver 32, blocks 42 meet to form a trunnion support 44. Additionally, protrusions 70 extend inwardly from side elements 33 and 34 which are received in apertures 72 formed in trunnion 18, securely retaining trunnion 18 therebetween. Barrel assembly 15 is coupled to upper receiver 32 by capturing trunnion 18 between opposing side elements 33 and 34 at forward ends 36, supported by trunnion support 44. An inset intermediate block 45 extends inwardly from each of side elements 33 and 34 intermediate forward end 36 and rearward end 37. When side elements 33 and 34 are joined to form upper receiver 32, blocks 45 meet to form a pivot block acting as a pivot point for lower receiver 35. It will be understood that the term "block 45" is used to indicate a pivotal attachment point for lower receiver 35, and is intended to include blocks of material as illustrated or other inwardly extending structures such as pins, rods and the like. Apertures 46 through side elements 33 and 34 at blocks 42 and 45 as well as along tops 38, receive fastener elements 48 such as screws for securely fixing side elements 33 and 34 together to form upper receiver 32. Alternatively, fastener elements 48 can include rivets that are formed in the inner surfaces of side elements 33 and 34 to couple them together.

Lower receiver 35 includes a forward end 50 received outwardly over block 45. Lower receiver 35 is hingedly coupled to blocks 45 by a pin 52. Lower receiver 35 is movable between an open position (FIG. 6) and a closed position (FIG. 3). When block 45 is a rod or pin shape, the lower receiver can include a hook shaped feature extending from the end thereof which is received over block 45 instead of pivotally pinned thereto using pin 52. In this instance, the open position can include pivoting about block 45 and/or the complete removal of lower receiver 35. A rearward end 54 of lower receiver 35 includes an aperture 55 which aligns with apertures 57 in rearward end 37 of side elements 33 and 34. A pin 58 retains lower receiver 35 in the closed position, passing concurrently through apertures 55 and 57. Lower receiver 35 carries trigger assembly 24, pistol grip 25, buttstock 15 and magazine 26. Trigger assembly 24 has been slightly modified to add a safety extension 56 to trigger assembly 24. Safety extension 56 extends rearwardly from trigger assembly 24 to engage a safety selector 59. Safety selector 59 is preferably an AR15 style switch.

Figure 5:
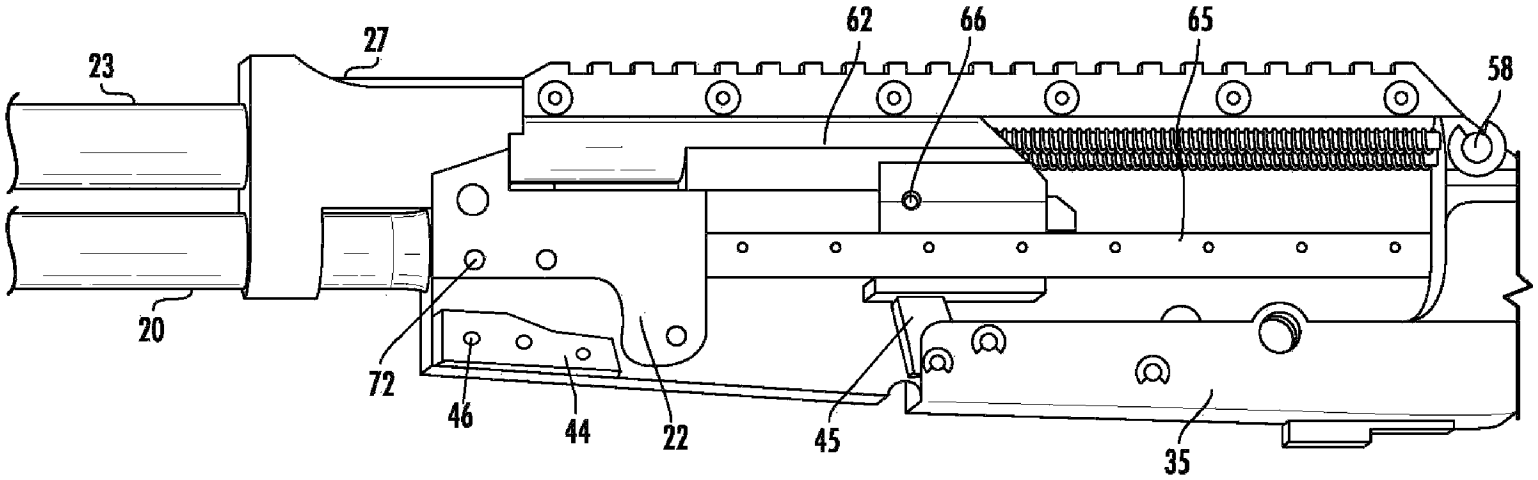
FIG. 5 is a partial sectional side view of the modified AK-47 of FIG. 3.
Figure 6:
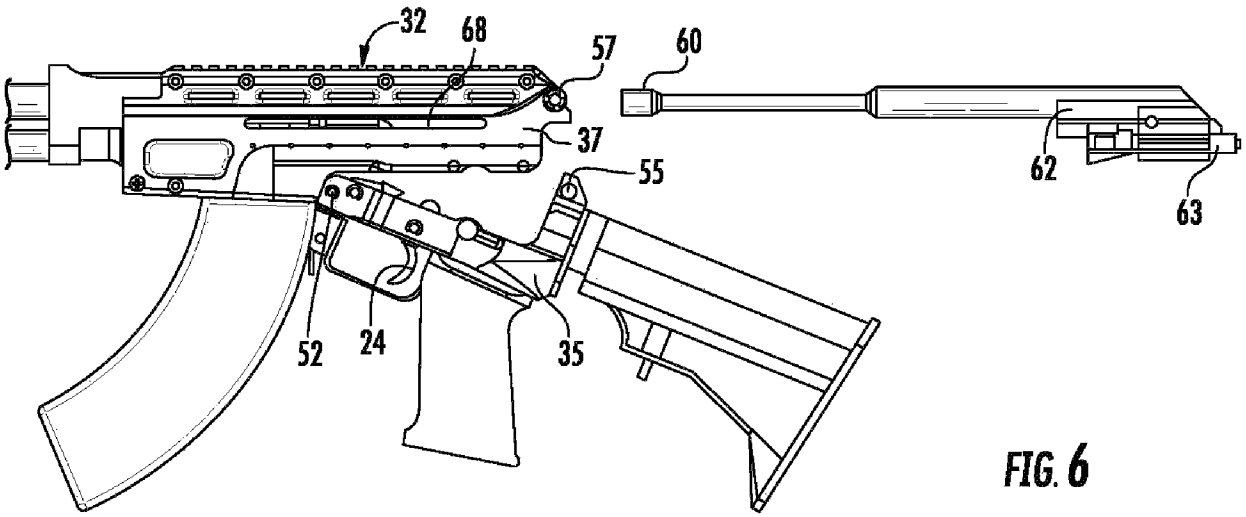
FIG. 6 is a side view of the AK-47 of FIG. 3 with the lower receiver in the open position and the bolt carrier and piston assembly removed.

Turning now to FIG. 5, with additional reference to FIG. 6, a gas piston 60, bolt carrier 62 and bolt 63 can be removed or inserted into position within upper receiver 32 through rearward end 37 thereof when lower receiver 35 is in the open position. Gas piston 60 is received within gas cylinder 23 when properly installed and bolt carrier 62 is guided along rails 65 attached to side elements 33 and 34. Rails 65 are preferably formed of steel to provide wear resistance, and can be bolted, riveted or the like to side elements 33, and 34. While separate rails 65 are employed, it will be understood that integral rails can be formed in side elements 33 and 34 instead. The operation of and details of gas piston 60, bolt carrier 62 and bolt 63 will not be described in detail since they are conventional (stock) elements of a conventional AK-47, with the exception of the charging handle being removed from the bolt carrier to permit use in upper receiver 32. The conventional charging handle is removed and apertures 66 are provided, one on each side of bolt carrier 62 to receive a replacement charging handle. Apertures 66 are intended to removably receive the replacement charging handle and allow for the charging handle to be positioned on the left or right side of AK-47 30. A corresponding slot 68 is formed in side elements 33 and 34 to accommodate the replacement charging handle.

The modification of a conventional AK-47 with upper receiver 32 and lower receiver 35 of the present invention, allows the components of conventional AK-47s to be used, while providing a rigid platform for barrel assembly 16, thereby increasing accuracy. Additionally, the upper receiver provides a rigid rail 40 to allow attachment of accessories, particularly optical sighting devices. Rail 40 is rigid and allows for sighting devices to be employed accurately. The ability to move lower receiver to the open position simply by removing pin 58, gives easy access to the interior of the firearm, including the trigger assembly and the bolt carrier.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. A receiver of an AK-47 style firearm comprising:
an upper receiver comprising:
a first side element;
a second side element coupled to the first side element;
a trunnion support formed between the first side element and the second side element proximate a forward end thereof; and
a pivot block formed between the first side element and the second side element intermediate the forward end and a rearward end thereof; and
a lower receiver hingedly coupled to the pivot block and movable between an open position and a closed position.

2. A receiver as claimed in claim 1 wherein the first side element and the second side element each contain a top which together form a rail for mounting accessories.

3. A receiver as claimed in claim 2 wherein the rail is a picatinny type rail.

4. A receiver as claimed in claim 1 wherein the trunnion support is formed from a forward block extending inwardly from each of the first side element and the second side element proximate the forward end thereof.

5. A receiver as claimed in claim 1 wherein the pivot block is formed from an intermediate block extending inwardly from each of the first side element and the second side element intermediate the forward end and the rearward end thereof.

6. A receiver as claimed in claim 1 further including a slot formed in the first side element and the second side element for receiving a charging handle.

7. A receiver as claimed in claim 1 further including integral rails formed in the first side element and the second side element for guiding a bolt carrier therealong.

8. A receiver as claimed in claim 1 further including:

a barrel assembly including a trunnion coupled to a rifle barrel, the barrel assembly coupled to the receiver with the trunnion captured between the first side element and the second side element and supported by the trunnion support; and a gas piston, a bolt carrier and a bolt are received into position within the upper receiver through the rearward end thereof when the lower receiver is in the open position.

9. An AK-47 style firearm as claimed in claim 8 wherein the lower receiver carries a trigger assembly, a pistol grip, a buttstock, and a magazine, each of which is a stock AK-47 element.

10. An AK-47 style firearm as claimed in claim 9 wherein the stock trigger assembly is modified to add a safety extension thereto, the safety extension extends rearwardly from the trigger assembly to engage a safety selector.

11. An AK-47 style firearm comprising:

an upper receiver comprising:

a first side element;

a second side element coupled to the first side element;

a trunnion support formed between the first side element and the second side element proximate a forward end thereof;

a pivot block formed between the first side element and the second side element intermediate the forward end and a rearward end thereof;

a lower receiver hingedly coupled to the pivot block and movable between an open position and a closed position;

a barrel assembly including a trunnion coupled to a rifle barrel, the barrel assembly coupled to the receiver with the trunnion captured between the first side element and the second side element and supported by the trunnion support; and a gas piston, a bolt carrier and a bolt are received into position within the upper receiver through the rearward end thereof when the lower receiver is in the open position.

12. An AK-47 style firearm as claimed in claim 11 wherein the first side element and the second side element each contain a top which together form a rail for mounting accessories.

13. An AK-47 style firearm as claimed in claim 11 wherein the trunnion support is formed from a forward block extending inwardly from each of the first side element and the second side element proximate the forward end thereof.

14. An AK-47 style firearm as claimed in claim 11 wherein the pivot block is formed from an intermediate block extending inwardly from each of the first side element and the second side element intermediate the forward end and the rearward end thereof.

15. An AK-47 style firearm as claimed in claim 11 further including a slot formed in one of the first side element and the second side element for receiving a charging handle.

16. An AK-47 style firearm as claimed in claim 11 further including integral rails formed in the first side element and the second side element for guiding the bolt carrier therealong.

17. An AK-47 style firearm as claimed in claim 11 wherein the lower receiver 35 carries a trigger assembly, a pistol grip, a buttstock, and a magazine, each of which is a stock AK-47 element.

18. An AK-47 style firearm as claimed in claim 17 wherein the stock trigger assembly is modified to add a safety extension thereto, the safety extension extends rearwardly from the trigger assembly to engage a safety selector.

* * * * *